United States Patent [19]

Widdowson et al.

[11] 4,231,713

[45] Nov. 4, 1980

[54] COMPRESSOR MODULATION DELAY VALVE FOR VARIABLE CAPACITY COMPRESSOR

[75] Inventors: Richard E. Widdowson, Dayton, Ohio; Ward J. Atkinson, Paradise Valley, Ariz.

[73] Assignee: General Motors Corporation, Detroit, Mich.

[21] Appl. No.: 28,252

[22] Filed: Apr. 9, 1979

[51] Int. Cl.[3] ..... F04B 1/28

[52] U.S. Cl. ..... 417/222; 417/269; 417/270

[58] Field of Search ..... 417/269–273, 417/218, 222

[56] References Cited

U.S. PATENT DOCUMENTS

| | | | |
|---|---|---|---|
| 3,062,020 | 11/1962 | Heidorn | 62/196 |
| 4,037,993 | 7/1977 | Roberts | 417/222 |
| 4,061,443 | 12/1977 | Black | 417/222 |
| 4,073,603 | 2/1978 | Abendschein | 417/222 |

*Primary Examiner*—William L. Freeh

*Attorney, Agent, or Firm*—Edward P. Barthel

[57] ABSTRACT

A modulation delay valve for a variable capacity compressor operative to prevent the premature reduction of the pumping capacity of the compressor. A compressor suction chamber pressure sensing bellows, located in a pressure control cell, regulates a hydraulic control valve which in turn controls the flow of oil to a hydraulic cylinder operative to vary the displacement of the compressor. The delay valve functions, by sensing a compressor discharge reference pressure, to delay the operation of the hydraulic control valve by cutting-off communication of the suction pressure signal to the bellows cell allowing the compressor to maintain its maximum pumping rate. Upon the compressor discharge chamber pressure falling below the reference pressure the delay valve discharge cavity pressure correspondingly falls, allowing the delay valve to open communication between the bellows control cell and the compressor suction chamber to resume modulation of the compressor.

2 Claims, 5 Drawing Figures

COMPRESSOR MODULATION DELAY VALVE FOR VARIABLE CAPACITY COMPRESSOR

This invention relates to a variable capacity compressor control assembly and more particularly to an improved pressure operated hydraulic control assembly incorporating a modulation delay valve to prevent premature reduction of pumping capacity of the compressor.

In the U.S. patent application Ser. No. 896,741, now abandoned, filed Apr. 17, 1978—Richard E. Widdowson, and assigned to the same assignee as the present application, a pressure operated hydraulic control valve assembly is described for varying the output of an air conditioning compressor via its hydraulically operated modulating cylinder. A continuation application Ser. No. 81,867 has been filed on Oct. 4, 1979. In the present invention an improved assembly is provided which incorporates a modulation delay valve associated with the hydraulic control valve for delaying the movement of the hydraulic control valve operator from a closed position to an open position, preventing premature reduction of pumping capacity of the compressor.

It is, accordingly, an object of the present invention to provide an improved pressure operated hydraulic control assembly for controlling the compressor of an air conditioning system which involves regulating the flow of pressurized hydraulic fluid to the compressor's modulating motive means by incorporating a modulation delay valve in association with the control assembly operative for delaying the opening of the movable operating means associated with the hydraulic control valve to prevent premature reduction of the pumping capacity of the compressor.

In the form of the invention shown the modulation delay valve is a high pressure activated valve fitted in or to the rear head of a variable displacement compressor. The delay valve functions to cut-off the communicating of suction pressure to the bellows cavity portion of the hydraulic control valve whenever the head pressure within the compressor attains a predetermined level.

In the variable displacement compressor described in the above-mentioned Widdowson patent application Ser. No. 896,741, a pressure sensing bellows operates a hydraulic control valve which in turn regulates the flow of oil to a hydraulic cylinder within the swashplate chamber of the compressor. The hydraulic cylinder operates to vary the displacement of the compressor by varying the angle of the swashplate. The control valve bellows receives a pressure signal from a low-side point in the system, such as the evaporator, the accumulator, the suction line, or the suction area within the rear head of the compressor. When the pressure being sensed by the bellows reaches a predetermined reduced level corresponding to the refrigerant within the evaporator reaching a predetermined temperature of approximately 32° F., the bellows extends and causes high pressure oil to flow into the hydraulic cylinder, filling the cylinder with oil. The result is that the mechanism is caused to reduce the displacement of the compressor by moving the swash plate toward a transverse relationship with the compressor shaft. Thus pressure within the evaporator is prevented from dropping below a preset level where freezing of moisture on the external evaporator surface could occur.

The above-described situation is satisfactory providing the bellows is sensing the pressure in or near the evaporator where the pressure drop of refrigerant flow to the compressor is not a control factor. Should the pressure sensed be at a point remote from the evaporator, such as the suction cavity of the compressor rear head, it will be appreciated that the pressure drop between the evaporator and such a remote downstream sensing point will be a control factor, resulting in premature destroking or modulation of the compressor. Such premature compressor modulation will result in a delay in bringing the area being cooled, such as the passenger compartment of the automobile, to a temperature providing a "personal" comfort level. To avoid the above-described premature modulation, applicant's delay valve senses the discharge pressure of the compressor and functions to prevent the compressor from destroking by blocking the pressure signal to the bellows of the hydraulic control valve.

Further objects and advantages of the present invention will be apparent from the following specification, reference being had to the accompanying drawings wherein.

Figure 1:
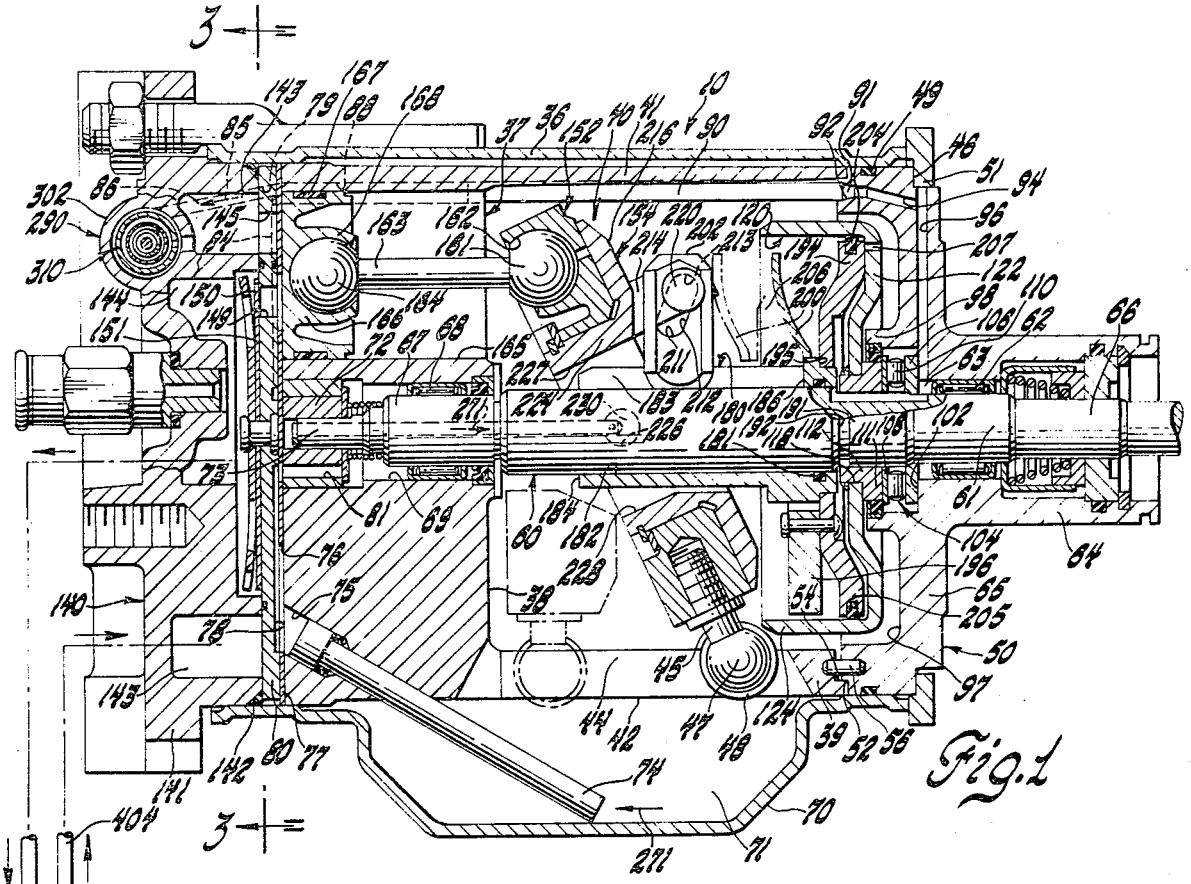
FIG. 1 is a vertical cross-sectional view of a variable capacity compressor of the axial wobble plate type for use in the present invention.

Referring now to the drawings, wherein a preferred embodiment of the present invention is shown, numeral 10 in FIG. 1 designates a variable displacement axial wobble plate compressor which is adapted to be driven by a main car engine through suitable means, one example of which is shown and described in U.S. Pat. No. 4,061,443, issued Dec. 6, 1977 to D. A. Black and B. L. Brucken. This patent shows a compressor driven from a car motor by a belt and pulley arrangement in combination with an electromagnetic clutch shown and described in U.S. Pat. No. 4,105,370, issued Aug. 8, 1978 to B. L. Brucken and R. E. Watt and assigned to the same assignee as the present application.

The compressor 10 includes an outer shell 36, which is substantially cylindrical in shape formed from sheet metal or as a casting. The shell 36 encircles an inner cylinder case, generally indicated at 37, preferably cast in one piece from aluminum. The case 37 comprises a rear cylinder block 38 and a front cylinder collar 39 with a wobble plate mechanism generally indicated at 40, positioned therebetween. The cylinder case 38 and collar 39 are interconnected by a pair of longitudinally extending stringers, one of which is indicated at 41, and a guide stringer 42 for the reception of a guide rod 45 supporting a universal ball 47 between a pair of guide shoe assemblies 48.

A front head 50 preferably formed as a separate member such as, for example, an aluminum casting, is partially telescoped at the right or front end of the shell 36 and is suitably sealed thereto by O-ring 49. An outer peripheral notch 46 is formed on the front head 50 for flush engagement of a ring 51, which ring is suitably secured as by welding to circumscribe the front end of the shell 36. The front head 50 has an inner annular recess 52 which telescopically interfits the complementary recess 54 of the collar 39 in nested fashion, which together with connecting pins 56 align compressor bores for reception of the compressor main drive shaft 60.

Drive shaft 60 has its forward bearing portion 61 rotatably mounted or journaled on front needle bearing 62 in axial bore 63 formed in protruding integral tubular extension 64 located on the outer surface of the front head and cover portion 65. The extension 64 is coaxial with and surrounds the shaft intermediate end 66 in concentric fashion. The shaft has its rearward reduced end 67 journaled on rearward needle bearing 68 in rear axial bore 69 of the cylinder block 38.

The shell 36 completely encloses the compressor wobble plate mechanism 40 and is provided with a distended bulge portion 70 forming an oil sump or crankcase region 71 which connects, by gravity flow, oil and refrigerant mixed therein received from piston blowby for circulation through the compressor by suitable oil flow passages providing a lubricating network for its associated bearings and seals. Lubricating oil gear pump means in the form of an oil pump assembly 72, driven by a D-shaped quill 73, providing a reduced end extension of the shaft rearward end 67, serves to withdraw oil and refrigerant solution from the sump 71 to an oil pickup tube 74. The tube 74 with its open upper end inserted in an angled counterbore 75 of the cylinder block 38, communicates via aperture 76 in reed valve disc 77 with an aligned vertical slotted passage 78, formed in the inner surface of the valve plate 80. The passage 78 has its upper end positioned in communication with the inlet side 81 of the oil pump 72.

Figure 3:
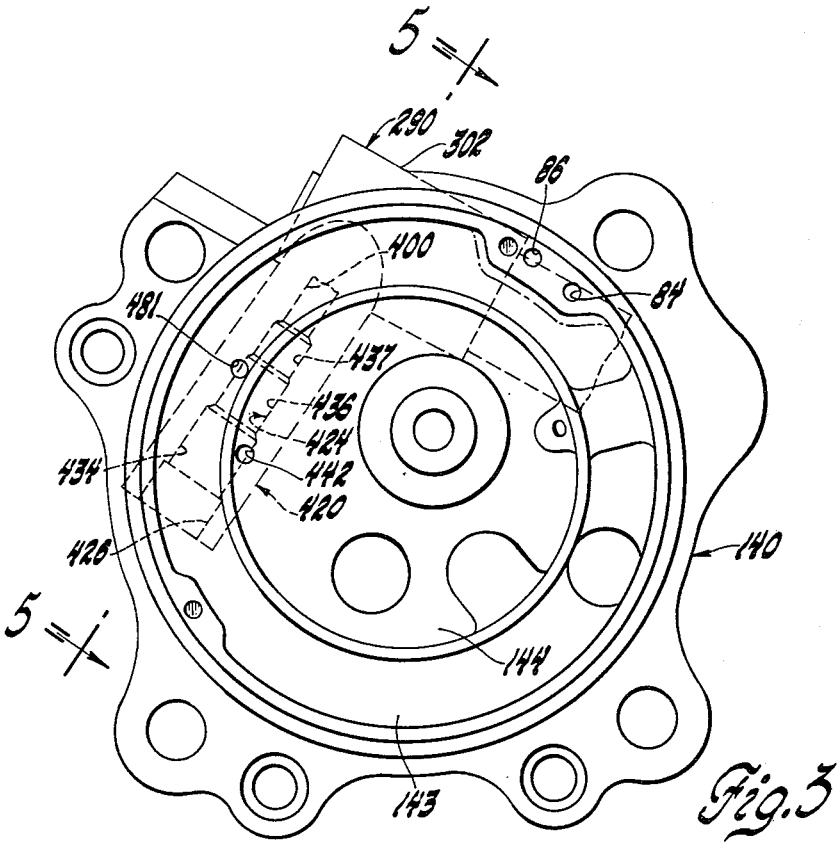
FIG. 3 is an elevational view of the rear head inner face taken substantially on the line 3—3 of FIG. 1.

The pump 72 outlet communicates with valve plate 80 upper oil outlet groove, indicated by dashed lines at 84, with the groove 84 extending radially outwardly and terminating adjacent the periphery of the valve plate 80 so as to communicate via a valve plate hole 79 with a rear head control valve housing inlet bore 86 (FIG. 3). The valve plate 80 includes an adjacent hole (not shown) interconnecting rear head valve housing exit passageway or bore 87 with the inlet of an axially extending cylinder block longitudinal duct 88 shown by dashed lines in FIG. 1. The forward or outlet end of the duct 88 is connected to the rearward end of an axially extending crossover tube 90, located outboard of the wobble plate mechanism 40. The crossover tube 90 portion of the compressor crossover passage means has its forward or outlet end reduced at 91, to provide a sealed press fit within the conical aperture 92 and the front head 50.

The front head 50 provides duct means communicating with the crossover tube outlet 91, in the form of an obliquely downwardly sloped duct portion 94, communicating with the outer end of a radial duct portion 96, the inner end of which is open to the front head axial bore 63. The front head inner face 97 includes a sleeve-like concentric extension 98 which, with the tubular extension 64, is formed integral with the front head. The rearwardly directed extension 98 encloses a counterbored shoulder portion 102 defining a thrust bearing surface on which is seated front thrust needle bearing assembly 104, including outer and inner thrust rings 106 and 108, respectively, having needle bearings 110 therebetween. The inner ring 108 is in flush engagement with flange 111 of cylinder bushing 112 fixedly centered, as by welding, in axial bore 118 of a cup-shaped modulation cylinder, generally designated 120. The cup-shaped cylinder 120 is oriented with its base 122 in opposed relation to the inner face 97 of the front head cover end wall portion 65. The modulation cylinder 120 has cylindrical wall portion 124 extending radially from its base 122 such that the open end of the cup-shaped cylinder 120 faces the wobble plate mechanism 40.

The valve plate 80 is maintained against the end of the cylinder block 38 by means of a cylinder rear head assembly 140 including a cylindrical portion 141 which telescopes within the aft end of the shell 36 and is sealed thereto by a compressible sealing means, shown in the instant form as an O-ring 142 sealed to the shell. The rear cylinder head assembly includes an outer suction or low pressure refrigerant gas inlet chamber 143 and a center refrigerant gas discharge high pressure chamber 144. As shown in FIG. 1, each compression chamber or bore 165 communicates with the suction chamber 143 through an inlet port such as port 145 shown in FIG. 2. The inlet reed valve disc 77 having inlet reeds (not shown), control the flow of refrigerant through the suction inlet port 145 as shown in greater detail in the above-mentioned Black et al U.S. Pat. No. 4,061,443. The compressed refrigerant gas leaves each compression bore 165 through valve plate discharge ports 149 (FIG. 1), while reed valves 150, formed in discharge reed valve disc 151, are located at each discharge port 149.

For purposes of illustration, the variable displacement five cylinder axial compressor 10 has been described. It will be understood, however, that the number of cylinders may be varied without departing from the scope of applicants' invention to be described.

With reference to FIG. 1, the wobble plate drive mechanism 40 includes a socket plate or collar 152 and journal or wobble plate 154. The wobble plate 154 rotates in unison with the shaft 60 by virtue of being pivotally connected thereto in a manner to be described. The socket plate 152 has five sockets formed therein, one of the sockets being shown at 162 for receiving the spherical ends 161 of each of five connecting rods, one rod being shown at 163. The free end of each of the connecting rods are provided with spherical portions 164 as shown by rod 163. Cylinder block 38 has a plurality of axial cylinder bores 165, there being five in the disclosed form, in which pistons 166 are sealed by rings 167. The pistons 166, having socket-like formations 168, which retain the spherical portion end 164 of an associated connecting rod 163. Thus, the pistons 166 operate within their associated compression chambers or bores 165, whereby upon rotation of the drive shaft 60 and the wobble plate 154 will result in reciprocation of the pistons 166. The wobble plate 154 is prevented from rotating by means of the guide shoes 48 which slide within the longitudinal slot 44 provided in the stringer 42.

The shaft 60 has a generally cylindrical sleeve member 180 surrounding or circumscribing the shaft in hydraulic sealing relation therewith by means of compressible sealing means such as O-ring seal 181 located in a groove in the inner surface 182 of the sleeve. The sleeve member 180 has formed therein a longitudinal slot 183 extending from the sleeve inner or rearward face 184 substantially the full length of the sleeve and terminates in a U-shaped radiused portion 186 within the confines of the cup-shaped cylinder 120.

As seen in FIG. 1, sleeve reciprocating actuator or modulating means are provided by a hydraulic expansible chamber including the cup-shaped rearwardly opening axially fixed element or modulating cylinder 120, which is secured by means of its bushing 112 on the shaft portion 191 by abutting against shaft shoulder 192 for rotation therewith. The actuator means further includes an axially movable internal disc-shaped modulating piston member 194 including a counterbalance 196 secured thereto. In the disclosed embodiment the modulating piston 194 abuts sleeve shoulder 195 and is fixed on the sleeve 180 for rotation therewith by means of a return spring member 200, as seen in FIG. 1. The spring 200 is suitably retained on the sleeve as shown for example in the mentioned Black et al U.S. Pat. No. 4,061,443. The spring member 200 is operative upon the modulating piston 194 and sleeve 180 being moved axially to the left from its full-line position in FIG. 1 to a compressed dotted line position contacting drive lug 202 upon the wobble plate mechanism 40 being pivoted to its vertical dotted line zero stroke position relative to the shaft 60. Thus, the spring member 200 functions to bias the wobble plate mechanism 40 from its zero stroke position normal to the shaft wherein the pistons 166 start pumping or compressing refrigerant gas. It will be noted that suitable hydraulic sealing means are provided between the disc-shaped piston 194 and the inner annular surface of the cylinder 120 which in the disclosed form is a resilient seal ring 204 located in a peripheral groove 205 formed in the edge of the piston.

The modulating piston member 194 cooperates with the cylinder 120 to form an expansible chamber 206 the size of which is varied by a hydraulic control system supplying lubricant under pressure into the chamber 206. At high lubricant pressures, the disc-shaped piston 194 and sleeve 180 will be shifted axially to the left as shown by dotted lines in FIG. 1. The chamber 206 may unloaded when the piston 194 is moved to the right by removal of hydraulic fluid from chamber 206 by suitable means such as a bleed hole shown at 207 in modulating cylinder base wall 122.

The shaft 60 drive lug portion 202 extends in a transverse or normal direction to the drive shaft axis. The lug 202 has formed therein a guide slot or cam track 212 which extends radially along the axis of the drive shaft. The journal element 154 carries an ear-like member 214 projecting normal to the journal forward face 216 and has a through bore for receiving cam follower means in the form of a cross pin driving member 220. As shown in the above-mentioned U.S. Pat. No. 4,061,443, the ear 214 is offset from but parallel to a plane common to drive shaft principal axis and the sleeve slot 183. Upon the cross pin 220 contacting bottom radius 211 of the cam track 212 the journal element 154 is disposed in a plane perpendicular to the axis of rotation of the shaft 60 rendering the compressor ineffective to compress refrigerant gas. This results from the pin 220 being located at the radially inward limit of cam track 212 defining minimum or zero stroke length for each of the pistons 166. FIG. 1 shows the arrangement of the wobble plate mechanism 40 for maximum compressor capacity wherein the pin 220 is positioned at the radially outer end of cam track 212 defining the maximum stroke lengths for each of the pistons. It will be noted that the drive lug 202 is received in a complementary bore in the drive shaft 60 and is suitably secured therein to properly align and lock the lug 202 against any movement in shaft bore 215.

As further shown and described in the above-mentioned U.S. Pat. No. 4,061,443, journal plate hub 224 has transverse bores 226 the axis of which intersects the rotational axis of shaft 60. Thus, the journal plate hub 224 receives the sleeve 180 in the hub's generally rectangular sectioned axial opening defined in part by upper and lower faces 227 and 228. Upon assembly the journal cross bores 226 are aligned with sleeve bores (not shown) for the reception of the hollow transverse pivot or trunnion pins 230 permitting the wobble plate assembly 40 to pivot thereabout.

The opposite radiused ends 211 and 213 of the cam track 212 provide one method to define respectively, the maximum and minimum stroke lengths for each of the pistons 166. The result is the wobble plate mechanism 40 provides essentially constant top-dead-center (TDC) positions for each of the pistons. The pin cam follower 220 interconnects the wobble plate mechanism 40 and the drive shaft 60 and is movable radially with respect to the lug 202 and the wobble plate mechanism 40 in response to the movement of the sleeve 180. The angle of the wobble plate mechanism 40 is varied with respect to the drive shaft 60, between the solid and dashed line positions shown, to infinitely vary the stroke lengths of the pistons 166 and thus the output of the compressor.

The hydraulic control circuit for the compressor 10 is indicated in part by short arrows 271 in FIG. 1. Thus, oil is drawn-up from the compressor sump area 71 through the pickup tube 74 through the aperture 76 in the suction inlet reed disc 77 and thence into the passage means in the form of a generally vertical slot or groove 78 formed in the inner face of the valve plate 80. The gear pump assembly 72 pressurizes the oil as the pump is rotated on the rearward end of the compressor shaft 60.

The modulation oil flow path, indicated in part by dashed arrow 85 shown in FIG. 1, involves flow from the outlet of the pump 72 into the valve plate oil outlet groove 84 for flow rearwardly through a hole (not shown) in the valve plate 80 and thence via rear head valve housing inlet bore 86 for entrance into the blind end region or inlet cavity 362 of a compressor displacement hydraulic control valve, generally indicated at 290 in FIG. 1. The control valve 290, which regulates the flow of fluid to the hydraulic modulating cylinder chamber 206, is the subject of the co-pending U.S. patent application Ser. No. 896,741, Richard E. Widdowson, filed Apr. 17, 1978 and assigned to the same assignee as the present application.

Figure 4:
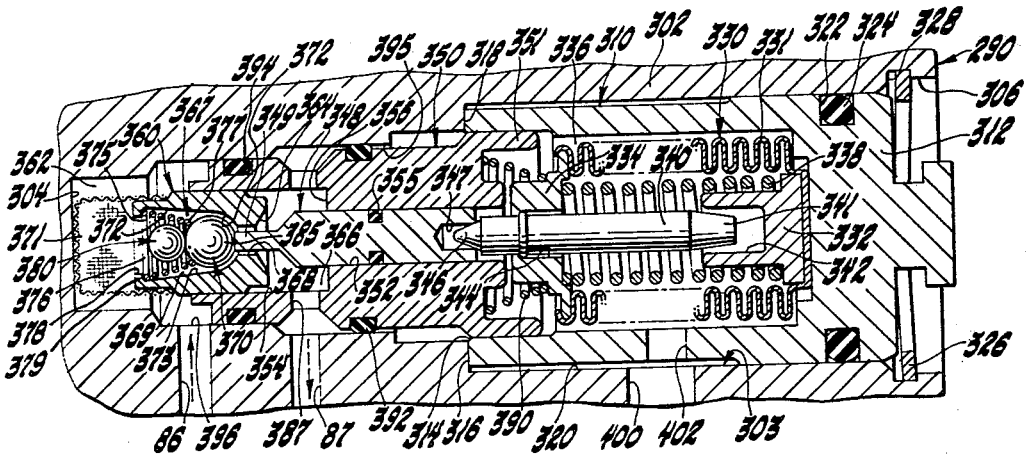
FIG. 4 is an enlarged sectional view of the hydraulic valve taken substantially on the line 4—4 of FIG. 2.

Turning now to a detailed description of the control valve, it will be seen in FIG. 4 that the hydraulic pressure operated control valve assembly 290 includes a housing 302 which in the preferred form is formed integrally in the rear head assembly 140, as seen in FIG. 1, defining a stepped blind bore 303, having a closed end 304 and an open end 306. A valve bellows cover, generally indicated at 310, in the form of a tubular member having a closed outer end 312 and an open inner end 314 disposed inwardly, is telescopically inserted into the housing open end 306. The bellows cover 310 is inserted sealingly into a fixed position in the one open end 306 of the housing stepped bore 303 with the cover free edge 316 engaged by shoulder 318 formed by outermost counterbore 320 of the stepped bore. In the preferred form the cover 310 has an annular groove 322 receiving an O-ring 324 which is in sealing contact with counterbore 320. Retaining means, such as C-ring 326, is snapped into interior groove 328 to hold the cover 310 in place. Thus, the bellows cover 310 has its closed end 312 positioned adjacent the open end 306 of the housing 302 and its open end 314 facing inwardly toward the closed end 304 of the housing stepped bore 303.

A sealed flexible bellows member 330 is concentrically located within the bellows cover 310 so as to be seated against its closed end 312. The bellows member 330 is a tubular cup-like thin-walled metal casing 331 with corrugations formed in its side surface having an outer end member 332 at its closed end and an inner end guide member 334 at its open end operative to seal the bellows interior. The inner end member 334 projects toward the open end 314 of the bellows cover while the opposite end member is seated on the closed end of the bellows cover. The interior of the bellows casing is evacuated so as to expand and contract in response to pressure changes within bellows cover pressure control cell 336 preset to a predetermined size. A compression coil spring 338, located interiorly of the bellows member 330, extends between the end members 332 and 334. The captured spring 338 is spaced and centered from a rod 340 such that the spring 338 normally maintains the bellows member 330 in an extended position. The bellows rod 340 is tapered at 341 and guided into axial recess 342 in the fixed end member 332 for over-travel movement of the rod inwardly of the bellows member 330. The rod 340 extends on the axis of the housing cover blind bore 303 through aligned guide bore 344 of the end member 334. The rod 340 has a pointed inner end 346 which seats into a coupling axial recess 347 of a valve pin member 348. The pin member 348 terminates at its inner end in a reduced valve needle or stem portion 349.

A cylindrical valve body, indicated generally at 350, is formed with an enlarged head portion 351 which is telescopically received in a press fit calibration manner within the open end 314 of the bellows cover 310. The valve body extends sufficiently within the top end 314 of the cover 310 to provide an axially adjustable sealed juncture operable during an assembly and setting procedure described in the above-mentioned U.S. patent application Ser. No. 896,741. It will be noted that when the valve body head 351 is press fitted within the bellows cover the rod pointed inner end automatically aligns and couples with the valve pin recess 347 whereby the bellows rod 340 and valve pin 348 move axially in unison.

A stepped axial bore extends through the valve body 350 defining first 352 and second 354 bores wherein the second bore 354 has a diameter of the order of twice the first bore 352 to define an internal shoulder 356. The first diameter bore 352 has its upper end located adjacent the bellows free end member 334 while the second diameter bore 354 is located adjacent the closed end 304 of the housing bore 303. The actuating pin member 348 is reciprocatingly sealed in the valve body first bore 352 by O-ring seal 355.

A valve sleeve member 360 is telescopically received in a press fit within the valve body second bore 354 to define with the closed end 304 of the housing an inlet cavity 362. The valve sleeve member 360 has an outwardly diverging or truncated cone-shaped portion 364 partially defining with the valve body shoulder 356 a fluid outlet cavity 366.

As best seen in FIG. 4, the valve sleeve member 360 is formed with an axial throat passage or outlet end 368 interconnecting a valve chamber 369 with outlet cavity 366. The valve chamber 369 has valve and guide means, generally indicated at 367, positioned therein for reciprocal movement. The valve and guide means comprises first 370 and second 380 ball segments and a conical coil compression spring 375 of helically wound wire. In the disclosed embodiment the valve chamber 369 has a bell-shaped configuration including a portion 373 converging from the chamber inlet end 378 in a manner to form a dome-shaped valve seat portion 372 of a predetermined radius at the chamber outlet end 368.

By virtue of the above-described arrangement the first valve ball segment 370 is movable in the dome-shaped valve seat portion 372 between valve open position shown and a valve closed position. The ball segment 370 is of a predetermined configuration and size to mate in sealing relation with the valve seat portion 372 when in the valve closed position. The conical coil compression spring 375, defining second resilient means for the control valve assembly, has large 376 and small 377 diameter ends. The valve and guide means 367 is axially positioned in the valve chamber 369 with its spring 375 having its large diameter end 376 suitably retained as by lip or flange 379 in the chamber.

Thus, as set forth in detail in the above-mentioned patent application Ser. No. 896,741, the large ball segment 370 is guidingly retained for movement in the valve chamber 369 between the valve open and closed positions by the coaction of the ball segments 370 and 380 with the spring 375 so as to be biased by the spring 375 toward the valve closed position against the valve seat portion 372. Upon the needle 349 engaging the large ball portion 385 through the outlet end 368 the needle 349 moves the valve and guide means 367 toward its valve open position against the bias of the spring 375. The outlet end 368 has a configuration sufficiently large simultaneously to receive the needle 349 and supply the hydraulic fluid in regulating the flow thereof to cavity 366 when the valve and guide means 367 is away from the valve seat portion 372 and between the valve open and valve closed positions.

The valve needle 349 has an outer diameter less than the inner diameter of valve throat outlet end 368 by a predetermined amount so as to simultaneously receive the needle 349 and supply the hydraulic fluid in regulating the outlet flow thereof when the valve and guide means 367 is away from the valve seat portion 372 and between the valve open and closed positions. Upon the unsealing of the valve ball segment 370 high pressure liquid is free to flow from inlet cavity 362 and ball chamber 369 through the valve chamber outlet end 368 into the outlet cavity 366 for exit via a pair of outlet ports into passage means 388. It will be noted that valve body 350 has a pair of O-ring seals 392 and 394 positioned in sealing engagement with housing counterbore portions 395 and 396 respectively, on either side of the outlet cavity ports 387 to seal the outlet cavity and its outlet passage 388 from the inlet cavity 362 and the bellows cell 336. A valve screen, shown at 371, is provided in the inlet cavity 362 to filter out particles from fluid entering the ball chamber 369.

As more fully disclosed in the application referred to above, upon axial inward movement of the needle 349, caused by the extension of the bellows member 330 against spring 390, the needle free end 397 contacts ball portion 385 to move and unseat same compressing spring 375 substantially along the principal axis of the valve chamber. First resilient means, in the form of the conical compression spring 390, is concentrically positioned or centered intermediate the bellows end member 334 and the ring-shaped depression 398 of valve housing 350. The coil spring 390 urges the bellows 330 into engagement with the closed end 312 of the cover 310 and thus away from the valve pin member 348. The second resilient means, in the form of the conical ball spring 375, acts to bias the valve ball segment 370 in a direction toward the left to seat the ball segment 370 and close communication between the inlet cavity 362 and the outlet cavity 366. It will be noted that the compression spring 338, which is encapsulated in the evacuated bellows member 330 provides, in combination with the bellows casing, a pressure dependent displacement. In the disclosed form the pressure inside the bellows member 330 may be either absolute zero or gas-charged to a reference pressure, referenced to zero.

All of the foregoing structure is disclosed in the above-mentioned application of Richard E. Widdowson and, as stated above, the disclosure thereof is incorporated by reference.

Figure 2:
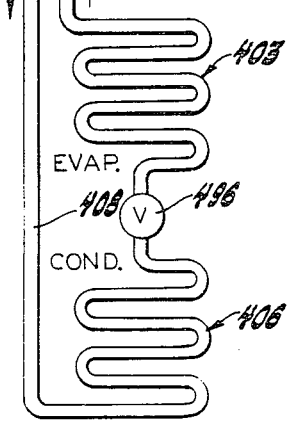
FIG. 2 is an elevational view of the compressor rear head showing the relative locations of the hydraulic control valve and the modulation delay valve.
Figure 2:
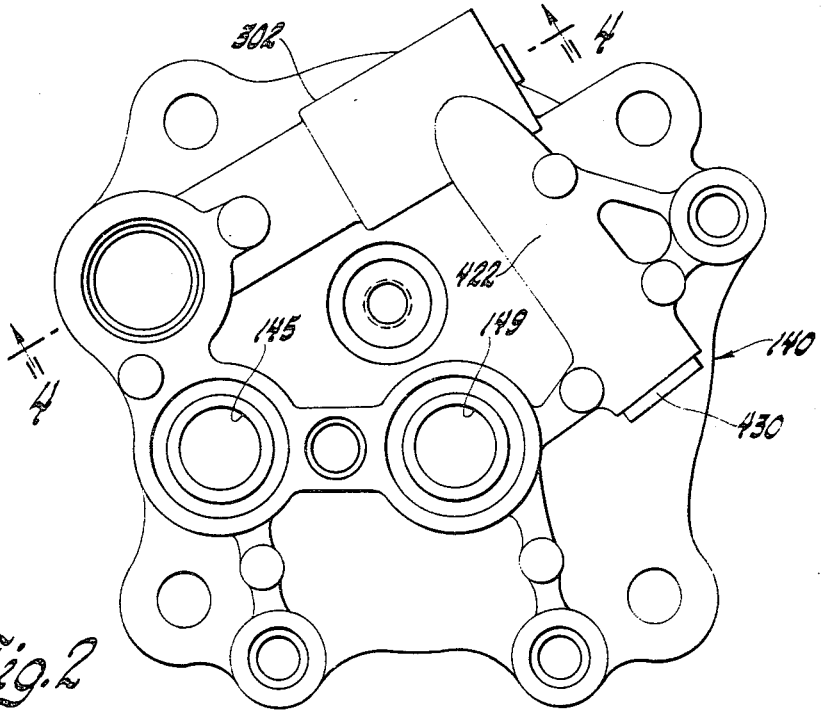

As seen in FIGS. 2, 3 and 4 in the preferred embodiment, the hydraulic control valve 290 has its stepped fluid bore 303 formed in the rear head assembly 140 with its principal axis oriented such that the pressure control point for the hydraulic valve is sensed from the compressor control suction cavity 143 by means of aperture or passage 400 extending through the rear head valve housing 302 aligned with bellows cover aperture 402. As seen in FIGS. 1 and 2, the suction cavity inlet port 145 is connected to the outlet of the system evaporator 403 through tubular means 404. Further, the discharge cavity outlet port 146 is connected to the inlet of the system evaporator 403 through tubular means 408.

As described in the application Ser. No. 896,741 referred to above if the compressor 10 is operating at or near maximum capacity and little or no refrigeration is required the high side pressure will build up and the low side or suction pressure in cavity 143 will drop, for example, to a value approaching a pressure of about 30 psig. Dropping the low side or suction pressure lowers the cooling coil or evaporator temperature. If the pressure transmitted from the cavity 143 is reduced to the cell control setting pressure, i.e. about 30 psig., the bellows 331 expands and extends the valve pin needle 349 unseating the ball portion 385. The result is that oil is allowed to exit the housing outlet passageway 388 at a pressure of about 45 psig. for flow into the compressor modulation chamber 206 to expand same and, via the wobble plate 152 being pivoted to its dashed-line position, start reducing the compressor pistons 166 stroke or travel, i.e. start "destroking" the compressor.

Upon pressure from the system control pressure area (suction cavity 143) again reaching or exceeding the pressure cell 336 setting pressure the bellows will retract, assisted by the first resilient means (spring 390) a sufficient distance to allow the second resilient means, (spring 375) together with the high oil pressure acting against the ball segments 370 and 380 to close or seat the ball portion 385 on the valve seat portion 372 totally restricting oil flow to the valve outlet cavity 366. The result is that the expansible chamber 206 is bled of oil through oil bleed hole or passage 207 by the swash plate mechanism's tendency to return to its full stroke position thus moving the modulation cylinder piston 194 toward its full line position shown in FIG. 1. It will be noted that the bleed passage 207 in cylinder base 122 is formed of a predetermined size (diameter of 0.8 mm and a length of 2.2 mm) or the same as the outlet opening of the mentioned calibrating circuit. Thus, applicant's valve is designed whereby the hydraulic system pressure developed by the pump 72 will produce the required pressure (45 psig.) in the chamber 206 while oil is being bled from passage 207.

Figure 5:
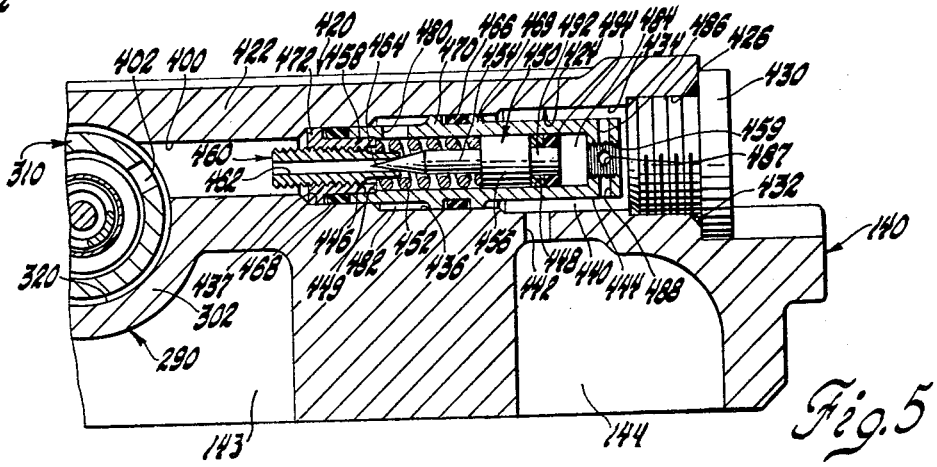
FIG. 5 is an enlarged sectional view of the modulation delay valve taken substantially on the line 5—5 of FIG. 3.

As seen in FIGS. 2, 3 and 5, a modulation delay valve 420 of the present invention, associated with the above-described compressor control arrangement, includes a housing 422, which in the preferred embodiment is formed integrally in the rear head assembly 140, defining a tangentially extending stepped valve bore 424. The valve bore 424 includes an outermost cylindrical counterbore portion 426 having internal screw threads formed therein. An end cap 430 is threadably secured in the portion 426, and an annular seal ring 432 is employed to seat the cap in a fluid-tight manner. A next outermost counterbore 434 provides a cylindrical surface which together with the cap 430 and a portion of a next innermost counterbore 436 define a concentric regulating chamber 440 in communication with the compressor inner discharge chamber 144 via port 442.

The modulation delay valve includes a sleeve 444 which is press fitted in the valve innermost counterbore 437 and itself contains a central bore consisting of an inner portion 446 of larger diameter and an outer portion 448 of smaller diameter separated by a shoulder 449. A needle rod valve element 450 is slidable in the sleeve bore portion 448. A bias spring 452 circumscribes the inner portion 454 of the rod valve element 450 between an enlarged diameter head portion 456 of the valve element and valve seat and spring retainer 458 to bias the rod valve element 450 in an outward position toward threaded valve axial bore 459 in the valve sleeve 444.

An adjustable valve seat member 460 with an axial flow passage 462 is provided such that the member 460 is threadably secured in the valve retainer 458. The rod valve element 450 has a pointed needle end 464 which upon being moved to its telescoped position within the outer or right-hand end of the axial passage 462, as shown in FIG. 5, operates to close the passage 462. It will be noted that valve sleeve 444 is sealably held in position by sealing means comprising a pair of O-rings 466 and 468. The O-ring 466 is positioned between sleeve flanges 469 and 470 while the O-ring 468 is fitted between spring retainer flange 472 and the inner end of the valve sleeve.

As seen in FIGS. 3 and 5, the modulation delay valve stepped bore 424 includes three spaced-apart ports formed therein. The first one of the ports is bore radial inlet port 442 communicating between bore annular chamber 440 and the compressor discharge chamber 144. The second one of the ports is bore radial inlet port 480 connected via rear head passage 481 and annular space 482 to the compressor suction chamber 143. The third one of the ports is stepped bore axial outlet port 400 connected to the pressure control cell 336 via bellows cover aperture 402. It will be noted that the first valve bore inlet port 442 communicates with the valve annular chamber 440 which in turn communicates with the valve sleeve pressure cavity 484 through a series of sleeve radial connecting passages 486, 487, 488 and sleeve threaded axial bore 459 whereby compressed refrigerant discharge gas is delivered to the cavity 484.

It will thus be seen that the modulation delay valve 420 is a high pressure activated valve fitted into the rear head 140 of the variable displacement compressor 10. The function of the valve 420 is to cut off the communication of pressure to the bellows pressure control cell 336 of the hydraulic control valve 290 whenever the refrigerant gas pressure within the compressor discharge chamber 144 reaches a predetermined value.

As described above the pressure sensing bellows 330 operates the control valve 290 so as to regulate the flow of oil to the hydraulic modulation expansible chamber 206 which operates the wobble plate mechanism 40 varying the displacement of the compressor 10. When the pressure in the compressor read head discharge chamber 144, sensed by the bellows 330, is reduced to a predetermined value corresponding to the refrigerant temperature within the evaporator 403 approaching 32° F. or 0° C., causing the bellows to extend and unseat the ball segment 370. The result is that pressurized oil from the oil pump 72 enters the modulation circuit via housing passage means 388, communicating with the hydraulic modulation cylinder 120 so as to expand chamber 206.

Filling the chamber 206 with oil moves the piston member 194 to the left toward its dashed-line position of FIG. 1 causing the wobble plate mechanism 40 to reduce the displacement of the compressor, thus keeping the pressure within the evaporator from dropping below a level corresponding to an air temperature above 32° F. or 0° C. where freezing of moisture on the external evaporator surface can occur. The above-described situation is normal providing the hydraulic control valve bellows 330 is sensing the system refrigerant gas suction pressure in or near the evaporator where a pressure drop of the refrigerant flow is not a control factor. It has been determined, however, that in a system where the suction pressure is sensed at a location remote from the evaporator, such as in the suction line near the compressor or in the suction gas inlet chamber 143, the pressure drop between the evaporator and said location becomes a control factor wherein premature modulation or early destroking of the compressor is encountered. Such premature modulation of the compressor results in a delay in removing heat from a vehicle's interior to achieve an interior or in-car temperature within a "personal" comfort level. Thus, with the compressor 10 shut down, and assuming the pressures between the compressor inlet and outlet to be substantially equal, spring 452 of applicants' modulation delay valve bias the piston-like needle rod valve element 450 in its unseated position opening passage 462 transmitting the discharge pressure signal of compressor chamber 144 to the bellows control cell 336.

In operation when the compressor 10 starts running, it pulls refrigerant from the evaporator coil 403 and forces it into the condenser coil 406, thus lowering the evaporator or suction pressure and increasing the condenser or discharge pressure. The result is that a relatively high pressure differential is developed in the system. At a predetermined pressure differential between the dicharge and suction pressure, pressure in valve cavity 484, acts on the valve element outer portion 492 and circumscribing seal 494. Upon the pressure force supplied overcoming the compression spring 452 it moves the valve element 450 to its seated position of FIG. 5 wherein the needle 464 enters the passage 462, thereby closing off any flow through passage 462 trapping the predetermined discharge pressure within the bellows control cell 336. As the trapped predetermined pressure in the cell 336 is above the compressor normal operating means, the wobble plate mechanism 40 does not destroke the compressor insuring that the compressor will operate at maximum or full stroke capacity during peak ambient loads such as initial vehicle start-up or acceleration periods.

As sufficient cooling of the car passenger compartment is achieved, expansion means, such as a conventional expansion valve 496, will open up allowing increased refrigerant to return to the evaporator. As the evaporator pressure and temperature are reduced the compressor discharge pressure decreases resulting in a reduction of the pressure differential in the modulation delay valve. When the pressure differential has been reduced to a second predetermined value, the return spring 452 urges the valve element 450 to the right to unseat the needle from the passage 462 opening the circuit from the bellows control cell 336 to the suction pressure chamber 144.

While the embodiment of the invention as herein disclosed constitutes a preferred form, it is to be understood that other forms might be adopted.

The embodiments of the invention in which an exclusive property or privilege is claimed are defined as follows:

1. In a control arrangement for an automotive air conditioning system including a variable capacity compressor, a condenser, evaporator and fluid conduit means connecting said compressor, condenser and evaporator in a refrigerant circuit, housing means for said compressor including refrigerant gas suction and discharge chambers formed therein, hydraulically operated modulating means for varying the pumping capacity of said compressor between minimum and maximum, means for continuously supplying hydraulic control fluid at a predetermined high pressure to said modulating means, a pressure operated hydraulic control valve assembly controlling said compressor modulating means including a pressure control cell and movable operator means, passage means adapted to communicate system pressure in said suction chamber to said control cell, a pressure responsive element in said control cell operative at a cell predetermined control pressure for moving said operator means from a closed to an open position when the system pressure in said suction chamber is less than said cell predetermined control pressure, thereby permitting the flow of hydraulic control fluid to said modulating means to reduce the pumping capacity of said compressor, the improvement comprising; a modulation delay valve associated with said control arrangement for delaying the movement of said movable operator from its closed position to its open position to prevent premature reduction of pumping capacity of said compressor, said modulation delay valve including a bore with three spaced-apart ports formed therein, the first one of said ports being an inlet port connected to said discharge chamber, the second one of said ports being an inlet port connected to said suction chamber, and the third one of said ports being an outlet port connected to said pressure control cell, a valve element movably mounted in said bore for opening and closing communication between said second and third ports, means in said bore on one side of said valve element forming a discharge pressure cavity connected to said first inlet port and on the other side of said valve element forming a suction pressure cavity connected to said second inlet port and adapted by movement of said valve element for communication with said third outlet port, and resilient means exerting a force on said valve element in one direction opposing the force exerted by refrigerant gas in said discharge pressure cavity when said pump is operating, the compressed gas in said discharge pressure cavity when said compressor is operating at maximum pump capacity being above a predetermined reference pressure whereby to exert a force on said valve element in the opposite direction causing said valve element to overcome said resilient means closing communication between said second and third ports and trapping refrigerant gas within said pressure control cell at a pressure greater than said predetermined cell control pressure, thereby keeping said movable operator means closed so as to cause said compressor to continue to operate at its maximum pumping capacity, and whereby upon the compressor discharge chamber pressure falling below said reference pressure the delay valve discharge cavity pressure correspondingly falls, allowing said delay valve resilient means to move said valve element in said one direction opening communication between said second and third ports, thereby connecting said pressure control cell to said compressor suction chamber to modulate the capacity of said compressor while obviating premature reduction of maximum pumping capacity of said compressor by said control valve assembly.

2. In a control arrangement for an automotive air conditioning system including a variable capacity compressor, a condenser, evaporator and fluid conduit means connecting said compressor, condenser and evaporator in a refrigerant circuit, a housing for said compressor including refrigerant gas suction and discharge chambers formed therein, hydraulically operated modulating means for varying the pumping capacity of said compressor between minimum and maximum, pump means for continuously supplying hydraulic control fluid at a predetermined high pressure to said modulating means, a pressure operated hydraulic control valve assembly formed in said housing controlling said compressor modulating means including a pressure control cell and movable operator means, passage means in said housing adapted to communicate system pressure in said suction chamber to said control cell, a pressure responsive element in said control cell operative at a cell predetermined control pressure for moving said operator means from a closed to an open position when the system pressure in said suction chamber is less than said cell predetermined control pressure, thereby permitting the flow of hydraulic control fluid to said modulating means to reduce the pumping capacity of said compressor, the improvement comprising; a modulation delay valve associated with said control arrangement for delaying the movement of said movable operator from its closed position to its open position to prevent premature reduction of pumping capacity of said compressor, said modulation delay valve including a bore in said housing with three spaced-apart ports formed therein, the first one of said ports being an inlet port connected to said discharge chamber, the second one of said ports being an inlet port connected to said suction chamber, and the third one of said ports being an outlet port connected to said pressure control cell, a valve element reciprocally mounted in said bore for opening and closing communication between said second and third ports, means in said bore on one side of said valve element forming a discharge pressure cavity at one end of said bore connected to said first inlet port and a suction pressure cavity at the opposite end of said bore connected to said second inlet port and adapted by movement of said valve element for communication with said third outlet port, and resilient means exerting a force on said valve element in one direction opposing the force exerted by refrigerant gas in said discharge pressure cavity when said pump is operating, the compressed gas in said discharge pressure cavity when said compressor is operating at maximum pump capacity being above a predetermined reference pressure whereby to exert a force on said valve element in the opposite direction causing said valve element to overcome said resilient means closing communication between said second and third ports and trapping refrigerant gas within said pressure control cell at a pressure greater than said predetermined cell control pressure, thereby keeping said movable operator means closed so as to cause said compressor to continue to operate at its maximum pumping capacity, and whereby upon the compressor discharge chamber pressure falling below said reference pressure the delay valve discharge cavity pressure correspondingly falls, allowing said delay valve resilient means to move said valve element in said one direction opening communication between said second and third ports, thereby connecting said pressure control cell to said compressor suction chamber to modulate the capacity of said compressor while obviating premature reduction of maximum pumping capacity of said compressor by said control valve assembly.

* * * * *

UNITED STATES PATENT AND TRADEMARK OFFICE

CERTIFICATE OF CORRECTION

PATENT NO. : 4,231,713

DATED : November 4, 1980

INVENTOR(S) : Richard E. Widdowson & Ward J. Atkinson

It is certified that error appears in the above-identified patent and that said Letters Patent are hereby corrected as shown below:

Column 7, line 36, "top" should read -- open --.

Column 11, line 8, "read" should read -- rear --.

Column 11, line 66, "means" should read -- pressure --.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*